United States Patent [19]

Robinson et al.

[11] 4,335,828

[45] Jun. 22, 1982

[54] REFUSE CONTAINER LID SYSTEM

[75] Inventors: Jimmie R. Robinson; Max E. Thompson, both of Silver Lake, Ind.

[73] Assignee: Flint & Walling, Inc., Silver Lake, Ind.

[21] Appl. No.: 184,275

[22] Filed: Sep. 5, 1980

[51] Int. Cl.[3] ..... B65D 43/14; B65D 51/04

[52] U.S. Cl. ..... 220/334; 220/1 T

[58] Field of Search ..... 220/334, 1 T; 16/163

[56] References Cited

U.S. PATENT DOCUMENTS 3,628,685 12/1971 Gordon ..... 220/334

*Primary Examiner*—George T. Hall

*Attorney, Agent, or Firm*—Marmaduke A. Hobbs

[57] ABSTRACT

A refuse container lid system for providing easily replaced interchangeable covers for the top of a refuse container, in which similar size covers are used on containers of various volumes. A stationary plate is used to cover the portion of the top of the container not covered by the openable covers, and the size of the plate varies depending upon the size of the container. Hinge plates are attached to the side of the container, and have studs extending into tubular ends of the plate and covers. If two covers are used side by side, a pipe is disposed between the tubular portions of the covers, and the studs are disposed in the pipe. The hinge plate is adjustably connected to a bracket on the side of the container and can be removed to replace one or both of the covers.

6 Claims, 3 Drawing Figures

REFUSE CONTAINER LID SYSTEM

Large volume refuse containers, having capacities of several cubic yards or more, are used in many locations such as apartment complexes and the like, so that garbage can be neatly and sanitarily gathered in a central location for collection by a garbage truck. Frequently, containers of an appropriate size to hold a single day's refuse are used, and the containers are dumped daily by the collecting truck to minimize the occurrence of offensive odors from the container. A typical type container includes a bottom and four side walls, with means being provided whereby the refuse collecting truck can engage the container to raise the container off the ground and invert the container over a bin on the collecting truck, to empty the refuse therefrom. Normally, one or more hinged covers are provided on the top of the container, and as the container is inverted over the bin, the covers fall open, permitting the refuse to fall from the container into the bin on the truck. After the container is emptied, it is lowered back onto the ground, and as it is lowered the covers fall to the closed position.

It is preferred in such a container that the covers are freely movable about the hinge connection, so that they will open completely and close readily during the dumping operation. Further, when refuse is deposited into the container, the covers must be raised by the person placing the garbage therein. Since frequently a person will be carrying a bag of garbage in at least one hand, thus having only one hand free for opening the container, it is highly desirable that the cover or covers are easily opened while the container remains on the ground. Hence, a lightweight cover on a freely rotatable hinge is preferred; however, the process whereby the container is dumped is somewhat abusive to the cover. As the container is inverted, when the refuse falls from the container it often falls against the cover, forcing the cover against the back wall of the container. When the container is being lowered to the ground, the cover often slams closed forcefully. If lightweight materials are used for the covers, the repetitive forceful opening and closing thereof can cause structural damage to the covers, creating dents and bending the covers out of shape so that the covers will not rotate properly on the hinge or may not close the container completely. If the container is one which is dumped frequenly, particularly those dumped daily, noticeable damage can occur in a relatively short period of time. A dented and bent cover, besides not adequately closing the container, presents an undesirable appearance when the container is used near apartment complexes or other public areas.

Since the only alternative to a lightweight cover which is easily opened, yet will withstand the abusive opening and closing of the covers as the container is dumped, is a heavy cover with a complex spring assist system, many refuse container users prefer to use the lightweight covers and replace the covers when extensive damage occurs. One of the principal difficulties associated with the replacement of the covers on refuse containers is that, as previously mentioned, containers of a variety of different volumes are available, and since the width for all containers must remain substantially the same to accommodate lifting by the truck, the capacity of the container can be increased only by making the container taller, or by making the container deeper from front to back. Since the refuse is deposited through the top of the container, only moderate volume increases can be achieved through variations in the height of the container without making the top inaccessible. Therefore, in larger volume containers, the depth of the container from the front wall to the back wall is substantially greater than in smaller volume containers, and longer covers are required for the larger containers than for smaller containers. Hence, different size covers are required for each volume of container. For a large refuse collecting firm, which has a wide selection for the customer in the volume of container to be supplied, substantial expense and storage space are involved in maintaining an adequate supply of each size cover, to replace the covers as needed. Further, in manufacturing refuse containers of different sizes many different size covers must be made, and substantial investment and storage space are needed to maintain adequate inventories of covers for initial production and replacement supply.

It is therefore one of the principal objects of the present invention to provide a refuse container lid system which may be used on refuse containers of virtually any capacity, and which minimizes the number of different size covers necessary for a variety of volume containers by standardizing the cover size for the containers.

It is another object of the present invention to provide a refuse container lid system which includes a freely rotatable hinge for connecting the covers of the lid system to the container, thereby permitting free movement of the covers, and which includes covers that can be opened easily by a person depositing refuse as well as opened completely during dumping of the container.

A further object of the present invention is to provide a refuse container lid system which has a hinge which will connect several individual covers to the container for free movement of each cover, and which permits any or all of the covers to be quickly and easily removed for replacement.

Additional objects and advantages of the present invention will become apparent from the following detailed description and the accompanying drawings wherein.

Figure 1:
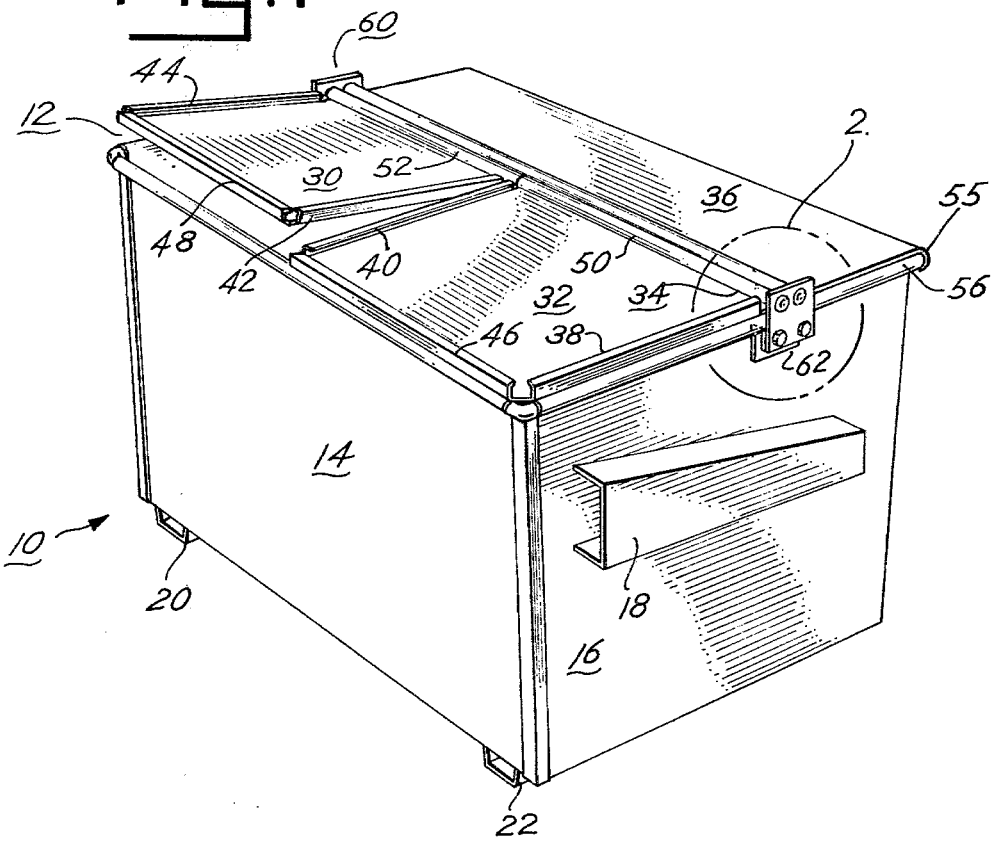
FIG. 1 is a perspective view of a refuse container having a lid system embodying the present invention.
Figure 2:
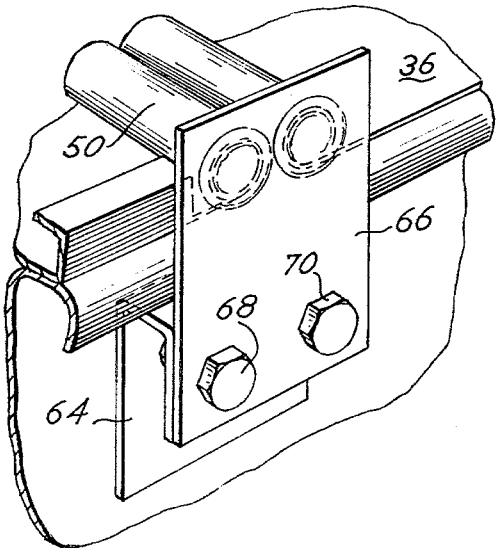
FIG. 2 is an enlarged perspective view of the area indicated by the circle designated with numeral 2 in FIG. 1, showing more clearly the hinge system of the present invention.

Referring more specifically to the drawings, and to FIG. 1 in particular, numeral 10 designates a refuse container having a lid system 12 embodying the present invention. The refuse container includes a front wall 14 and a back wall, not shown, with side walls 16 disposed therebetween. Lift pockets 18 are disposed on the side walls of the container, for receiving lift arms of the refuse collecting truck. Skids 20 and 22 are disposed under the floor, not shown, of the refuse container. The present lid system works equally well on various types of refuse containers other than the one shown in FIG. 1 such as, for example, containers having a different lift means, including the type having a single receiving pocket on front wall 14 rather than the dual side pockets of container 10. The present lid system will also work equally well on refuse containers which are not inverted for dumping but instead have openable floors which permit the refuse to drop out the bottom of the elevated container. By utilizing the present refuse container lid system, a manufacturer of virtually any type of refuse container can reduce the space and monetary investment required for maintaining adequate cover inventories; however, the system is particularly advantageous when used on the type of container which is inverted when dumped because of the previously mentioned necessity for replacement of the covers.

Lid system 12 includes covers 30 and 32 which are individually opened to deposit refuse, and which automatically fall open when the container is inverted and fall closed as the container is returned to the ground. The covers are connected to container 10 by a hinge 34 at the back edge of the cover, and a stationary plate 36 extends from hinge 34 to the back of the container, if the container is of sufficient front to rear depth to require use of the plates. Covers 30 and 32 are of sufficient length from front to back to cover the top opening of a small volume container. The same size cover is used on both the small and large volume containers; thus, interchangeability of covers is provided between various size containers. Hence, only one size cover is required, and the amount of space needed for storage of original and replacement covers is minimized. The size of stationary plate 36 from hinge 34 to the back of the container will vary depending upon the depth of the container from the front to the back walls. On the smallest containers no stationary plate is required, and on the larger containers the plate is wider than on the intermediate size containers.

Covers 30 and 32 may be of galvanized metal or other lightweight sheet metal material, and have side edges 38, 40, 42 and 44 extending upwardly from the main body of the covers. Similar inverted L-shaped edges 46 and 48 are provided on the front of the covers to provide a handle-like structure for grasping the cover when the container is opened to deposit refuse. The rear edges of the covers include rolled ends forming tubular portions 50 and 52 which form a part of hinge 34. Normally, stationary plate 36 is of a material similar to that of covers 30 and 32, and the plate has a tubular portion 54 on the front edge thereof connected to and forming a part of hinge 34. The back edge of stationary plate 36 near the rear wall of the container, is connected to the container by any suitable means such as, for example, bolts or screws, or by portions of the plate forming a channel 55 extending around the surface of and under the bottom edge of a lip 56, which is disposed along the top of the rear wall, front wall and side walls of the container. The channel-like connection just described is preferred, in that it permits attachment of the stationary plate by merely positioning the plate on the top of the container at the rearward edge thereof, and sliding the plate until the channel-like structure engages with lip 56 of the container.

In addition to tubular portions 50 and 52 of covers 30 and 32, and tubular portion 54 of stationary plate 36, hinge 34 also includes connecting ends 60 and 62 which rotatably attach the covers to the container. Connecting ends 60 and 62 are similar to each other in construction, and the description of end 62 which immediately follows is equally applicable to connecting end 60. A bracket 64 is disposed on side wall 16 and is connected thereto by bolts, welding or any other suitable means of attachment. A hinge plate 66 is attached to bracket 64 by bolts 68 and 70, and the hinge plate extends upwardly from the bracket past the top of the container walls. Studs 72 and 74 project inwardly from hinge plate 66, near the upper edge thereof. Stud 74 is disposed in tubular portion 54 of plate 36 and holds the front end of the plate against the top of container 10. A pipe 76 is disposed in tubular portions 50 and 52 of covers 30 and 32, and extends completely through both tubular portions, thereby permitting the covers to pivot independently of one another as they are opened and closed. Stud 72 is disposed in pipe 76 to attach the covers to the container while permitting the covers to be rotated relative to stud 72, along an axis defined by pipe 76.

Figure 3:
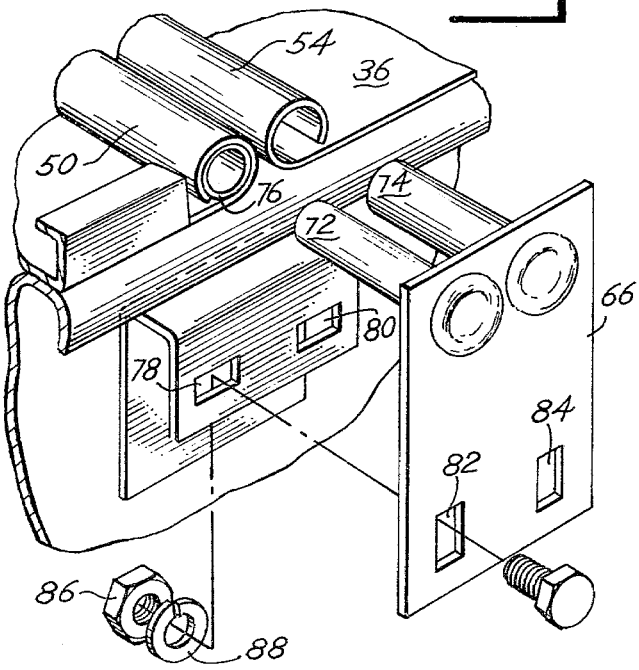
FIG. 3 is an exploded view of the hinge shown in FIG. 2.

As shown in FIG. 3, it is preferred that holes 78 and 80 in bracket 64 and holes 82 and 84 in hinge plate 66 be rectangular in shape and opposite in orientation. Hence, holes 78 and 80 are disposed horizontally in the bracket; and holes 82 and 84 are disposed vertically in hinge plate 66. When bolts 68 and 70 are inserted through the holes of the bracket and hinge plate, the hinge plate is movable relative to the bracket. Thus, the hinge plate may be moved vertically or horizontally, as required, to properly align studs 72 and 74 with the covers and stationary plate. When properly aligned, the bolts are fastened with nuts 86 and lock washers 88.

In the use and operation of a refuse container lid system embodying the present invention, if the container is of a size to require the use of a stationary plate 36, the plate is aligned laterally on top of the container and is moved forwardly thereon until channel 55 along the rear edge thereof engages with lip 56 on the rear wall of the container. Pipe 76 is inserted through tubular portions 50 and 52 of coves 30 and 32, and the covers, with the pipe inserted therein, are placed adjacent stationary plate 36 on top of the container, and studs 72 and 74 are inserted into pipe 76 and tubular portion 54, respectively. Bolts 68 and 70 are inserted into holes 78, 80, 82 and 84 to attach hinge plate 66 to bracket 64. Stud 74 holds the forward edge of stationary plate 36 along the top of the container and, since the rear edge of the plate is attached to the lip on the container, the plate is essentially immovable when the lid system is completely assembled. Since the forward edges of covers 30 and 32 are free, and tubular portions 50 and 52 are rotatable relative to stud 72, covers 30 and 32 may be opened and closed, permitting access to the container for depositing refuse therein. As the container is inverted to be emptied, the covers fall open, and the refuse falls from the container into the refuse truck. When the container is lowered back onto the ground the covers fall closed.

If one or both covers are damaged extensively so that replacement is required, bolts 68 and 70 are removed from hinge plate 66 and bracket 64. Studs 72 and 74 are removed from the cover and stationary plate, and the damaged cover may then be slid longitudinally along pipe 76 until the cover is completely removed from the pipe. A new cover can then be slid onto the pipe, and hinge plate 66 reattached to bracket 64. It is unnecessary to remove an undamaged cover if only one cover requires replacement, in that either of the connecting ends 60 or 62 may be disassembled to remove either cover 30 or cover 32. Replacement of one or the other or both covers may be done quickly with the simplified hinge structure of the present invention, since only two bolts are used to secure each side of the hinge. If a one piece cover is used instead of the dual cover structure shown in FIG. 1, pipe 76 may be eliminated as there is no need to interconnect the center portion of the lid system. When only one cover is used and pipe 76 is not required, stud 72 is inserted directly into tubular portion 50 and the cover is rotatable about the stud. Only one size cover need be kept in stock for initial installation or for subsequent replacement of damaged covers in that covers 30 and 32 are interchangeable on the left or right side, respectively, and the various size containers all have the same size cover, with only the width of stationary plate 36 varying from the small to the large volume containers. Since the stationary plate is permanently attached to the container, and will seldom require replacement, the number of covers which must be maintained as adequate inventory for timely replacement of damaged covers is greatly reduced. The covers are freely rotatable about an axis defined by pipe 76, and open and close easily for the deposit of refuse and for emptying the container.

Although one embodiment of a refuse container lid system has been shown and described in detail herein, various changes may be made without departing from the scope of the present invention.

We claim:

1. A refuse container lid system comprising a pair of covers disposed adjacent each other on the top of the container and having tubular portions along the back in an end to end relationship, hinge plates disposed along the outer edge of each of said covers near the ends of said tubular portions, a pipe disposed in said tubular portions and extending between said covers, means for attaching said plates to the container, studs in said hinge plates extending into opposite ends of said pipe and being sufficiently smaller than the hole in said pipe that said cover can rotate about said studs relative to said plates, a top plate disposed on the top of the container along the rear thereof, and having a tubular portion adjacent said tubular portion of said covers, and studs from said hinge plates extending into opposite ends of the tubular portion of said rear top plate.

2. A refuse container lid system as defined in claim 1 in which said means includes brackets attached to the sides of the container, and said hinge plates are connected to said brackets.

3. A refuse container lid system as defined in claim 2 in which bolts connect said hinge plates to said brackets and are disposed in rectangular openings in said hinge plates and brackets.

4. A refuse container lid system as defined in claim 3 in which said covers include upwardly extending side and front edge pieces having inwardly extending flanges.

5. A refuse container lid system as defined in claim 1 in which a means secures said top plate to the rear edge of said container to prevent said top plate from opening when the container is inverted.

6. A refuse container lid system as defined in clam 5 in which a means securing said top plate to said container consists of a rolled edge embracing the upper rear edge of said container.

* * * * *